US011781346B2

(12) United States Patent
Maeng

(10) Patent No.: US 11,781,346 B2
(45) Date of Patent: Oct. 10, 2023

(54) LATCH STRUCTURE

(71) Applicant: ZIGBANG CO., LTD., Seoul (KR)

(72) Inventor: Chul Ho Maeng, Seoul (KR)

(73) Assignee: ZIGBANG CO., LTD., Seoul (KR)

( * ) Notice: Subject to any disclaimer, the term of this patent is extended or adjusted under 35 U.S.C. 154(b) by 19 days.

(21) Appl. No.: 17/514,359

(22) Filed: Oct. 29, 2021

(65) Prior Publication Data

US 2022/0349213 A1 Nov. 3, 2022

(30) Foreign Application Priority Data

Apr. 30, 2021 (KR) ..... 10-2021-0056864

(51) Int. Cl.
*E05B 55/12* (2006.01)
*E05C 1/08* (2006.01)
(Continued)

(52) U.S. Cl.
CPC ..... *E05B 55/12* (2013.01); *E05B 15/04* (2013.01); *E05C 1/08* (2013.01); *E05C 3/22* (2013.01);
(Continued)

(58) Field of Classification Search
CPC ..... Y10T 292/0969; Y10T 292/06; Y10T 292/0863; Y10T 292/0864; Y10T 292/0886; Y10T 292/0887; Y10T 292/1031; Y10T 292/1037; Y10T 292/0889; Y10T 292/089; Y10T 292/0892; Y10T 292/098; E05B 55/12; E05B 15/04; E05B 2015/0413; E05B 2015/0455; E05B 15/10; E05B 15/102; E05B 15/104; E05B 17/20; E05B 17/2003; E05B 17/2007; E05B 17/2015; E05B 17/2019; E05B 17/2026; E05B 17/2057; E05B 17/2084; E05B 55/00; E05B 17/2069; E05B 17/2703;
(Continued)

(56) References Cited

U.S. PATENT DOCUMENTS 2,107,300 A * 2/1938 Kilpatrick ..... E05B 63/127 292/192
2,591,647 A * 4/1952 Welch ..... E05B 55/12 70/151 R
(Continued)

FOREIGN PATENT DOCUMENTS

CA 2892696 A1 * 6/2014 ..... E05B 15/102
CN 1427914 A * 7/2003 ..... E05B 63/0021
(Continued)

*Primary Examiner* — Kristina R Fulton
*Assistant Examiner* — Steven A Tullia
(74) *Attorney, Agent, or Firm* — The PL Law Group, PLLC

(57) ABSTRACT

A latch structure according to an embodiment includes a body, a locking body, a latch head, a plunger, and a latch stopper. The body is disposed inside a door. The locking body moves in response to an external operation. The latch head protrudes from the body to maintain the door in a closed position, and rotates when the locking body is spaced apart at least a predetermined distance. The plunger retracts into the body to prevent the latch head from rotating while the door is being closed. The latch stopper prevents the protruding latch head from retracting into the body when the plunger is maintained within the body.

9 Claims, 6 Drawing Sheets

(51) Int. Cl.
*E05B 15/04* (2006.01)
*E05C 3/22* (2006.01)

(52) U.S. Cl.
CPC ..... *E05B 2015/0413* (2013.01); *E05B 2015/0455* (2013.01)

(58) Field of Classification Search
CPC ..... E05B 17/203; E05B 17/2034; E05B 17/2049; E05B 17/2053; E05B 17/208; E05B 57/00; E05B 63/18; E05B 63/185; E05B 63/20; E05C 1/08; E05C 3/22; E05C 1/085; E05C 1/12; E05C 1/16; E05C 1/163; E05C 2005/005
See application file for complete search history.

(56) References Cited

U.S. PATENT DOCUMENTS 2,696,398 A * 12/1954 Teetor ..... E05B 57/00 292/64
2,784,019 A * 3/1957 Des Combes ..... E05B 65/0817 292/192
3,257,135 A * 6/1966 Russell ..... E05B 59/00 292/192
3,266,276 A * 8/1966 Yulkowski ..... E05B 59/00 70/151 R
3,316,001 A * 4/1967 Russell ..... E05B 57/00 292/153
3,337,250 A * 8/1967 Russell ..... E05B 57/00 292/210
3,359,027 A * 12/1967 Schlage ..... E05B 59/00 292/222
3,397,002 A * 8/1968 Russell ..... E05B 57/00 292/192
3,469,876 A * 9/1969 Armstrong ..... E05B 59/00 292/177
3,480,314 A * 11/1969 Robinson ..... E05B 55/005 292/64
4,135,746 A * 1/1979 Sterling ..... E05C 5/00 292/192
4,516,798 A * 5/1985 Bergen ..... E05B 55/12 292/169.13
5,113,676 A * 5/1992 Panossian ..... E05B 55/12 70/462
5,611,581 A * 3/1997 Ghostley ..... E05B 63/0021 292/165
2010/0109349 A1* 5/2010 Peabody ..... E05B 55/12 292/194
2015/0330100 A1* 11/2015 Helisten ..... E05B 15/108 292/157
2017/0122003 A1* 5/2017 Maniaci ..... E05B 63/20

FOREIGN PATENT DOCUMENTS

CN 108699865 A * 10/2018 ..... E05B 17/2007
CN 108291406 B * 11/2019 ..... E05B 15/0053
DE 102005039958 A1 * 3/2007 ..... E05B 59/00
DE 102016207939 A1 * 11/2017 ..... E05B 55/00
FR 2829520 A1 * 3/2003 ..... E05B 15/102
FR 2885155 A1 * 11/2006 ..... E05B 65/102
GB 2203794 A * 10/1988 ..... E05B 47/0002
GB 2383079 A * 6/2003 ..... E05B 55/12
KR 200177989 Y1 * 6/1997 ..... E05C 3/22
KR 20050036520 A * 4/2005 ..... E05B 15/10
KR 10-0543715 B1 1/2006
WO WO-2005003494 A1 * 1/2005 ..... E05B 15/102
WO WO-2009014428 A1 * 1/2009 ..... E05B 15/102
WO WO-2009096892 A1 * 8/2009 ..... E05B 15/102
WO WO-2016033805 A1 * 3/2016 ..... E05B 15/10
WO WO-2017160822 A2 * 9/2017 ..... E05B 15/04
WO WO-2020130904 A1 * 6/2020 ..... E05B 15/10

* cited by examiner

LATCH STRUCTURE

CROSS REFERENCE TO RELATED APPLICATION

This application claims priority from Korean Patent Application No. 10-2021-0056864, filed on Apr. 30, 2021, which is hereby incorporated by reference for all purposes as if fully set forth herein.

BACKGROUND

1. Field

Embodiments of the present disclosure relate to a latch structure and, more particularly, to a tubular latch structure.

2. Description of Related Art

In general, a device configured to lock and unlock a door that swivels with respect to a door frame is referred to as a door lock device. Modern steel doors are generally provided with a door mortise, in which a latch bolt assembly configured to be opened by a user operating a handle on the indoor side or the outdoor side of the door may be provided.

In addition, a tubular latch bolt having the shape of a cylinder may be disposed on a door made of wood. The latch head of the tubular latch bolt may be located in a position retracted into an opening-closing recess in the door to maintain the door in a locked position. The user may retract the latch head into the door using a rotary lever or a push-pull type handle in order to easily open the door.

However, in the case of a tubular latch bolt of the related art, when the lever or handle is operated by the user, the latch head is retracted into the door through linear movement. When the user opens the door before the latch head is completely retracted, a collision may frequently occur between the latch head and a striker, which is problematic. In addition, it is difficult to use the tubular latch bolt in an automatic driving mechanism using a handle structure, a motor, or the like. This is because a shaft must rotate about 35° to 45° so that the protruding latch of the tubular latch bolt can be inserted. In the push-pull handle, it is difficult to generate such rotation. When such rotation is generated in a motor driving mechanism, power consumption may be increased through friction of the latch bolt and burden on the motor may also be increased, thereby degrading durability of the motor.

The information disclosed in the Background section is only provided for a better understanding of the background and should not be taken as an acknowledgment or any form of suggestion that this information forms prior art that would already be known to a person having ordinary skill in the art.

SUMMARY

Embodiments of the present disclosure provide a latch structure enabling a latch head to be released by a small number of revolutions of a shaft.

Embodiments of the present disclosure also provide a latch structure enabling a tubular latch bolt to use a push-pull mechanism or an automatic opening-closing (or motor driving) mechanism.

Embodiments of the present disclosure also provide a latch structure able to prevent a latch bolt from being released by impurities.

According to an embodiment of the present disclosure, a latch structure may include: a body disposed inside a door; a locking body movable in response to an external operation; a latch head protruding from the body to maintain the door in a closed position and being rotatable when the locking body is spaced apart at least a predetermined distance; a plunger retracting into the body to prevent the latch head from rotating while the door is being closed; and a latch stopper preventing the protruding latch head from retracting into the body when the plunger is maintained within the body.

The latch stopper may include a slope portion on one end thereof. The other end of the latch stopper may be retracted into the latch head in response to the slope portion being pushed toward an inner surface of the body.

One end of the latch stopper may be pushed toward the inner surface of the body by a plunger spring connected to the plunger.

The plunger may include a rib provided on a portion thereof to prevent the other end of the latch stopper from being retracted into the latch head when the plunger is protruded from the body.

The latch head may prevent the other end of the latch stopper from moving upward when the latch head is retracted into the body.

The plunger may include a protrusion configured to be caught by the latch head when the latch head is retracted into the body, so that the plunger is retracted into the body along with the latch head.

The latch stopper may include a cutting portion configured to prevent the other end of the latch stopper from being retracted into the latch head by the rib of the plunger when the plunger is retracted into the body.

The latch structure may include further include a latch spring providing restoring force to rotation of the latch head.

When a shaft is rotated while the door is being opened, the locking body may be pulled by a link guide to form the predetermined distance between the locking body and the latch head.

According to embodiments of the present disclosure, the latch structure enabling a latch head to be released by a small number of revolutions of a shaft may be provided.

In addition, according to embodiments of the present disclosure, the latch structure enabling a tubular latch bolt to use a push-pull mechanism or an automatic opening-closing (or motor driving) mechanism may be provided.

Furthermore, according to embodiments of the present disclosure, the latch structure able to prevent a latch bolt from being released by impurities may be provided.

BRIEF DESCRIPTION OF DRAWINGS

The above and other objectives, features, and advantages of the present disclosure will be more clearly understood from the following detailed description, taken in conjunction with the accompanying drawings, in which.

DETAILED DESCRIPTION

Hereinafter, specific embodiments of the present disclosure will be described in detail with reference to the accompanying drawings. It should be understood, however, the description is provided for illustrative purposes only and not provided to limit the present disclosure.

In the following description of the present disclosure, detailed descriptions of known functions and configurations incorporated herein will be omitted in the situation in which the subject matter of the present disclosure would be rendered unclear thereby. The terms used hereinafter are defined in consideration of functions used in the present disclosure, and may be changed according to the intent of users or operators or practices. Accordingly, the terms should be defined on the basis of the entire description of the present specification.

The technical principle of the present disclosure is defined by the Claims. The following embodiments are merely a means for effectively describing the technical principle of the present disclosure to a person having ordinary knowledge in the technical field to which the present disclosure pertains.

Figure 1A:
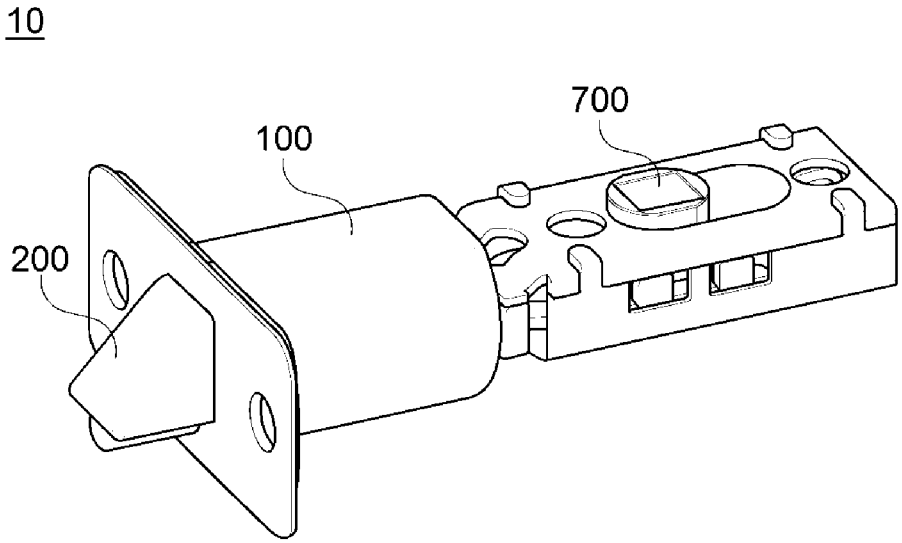
FIGS. 1A and 1B are perspective views illustrating a latch structure according to an embodiment of the present disclosure.
Figure 1B:
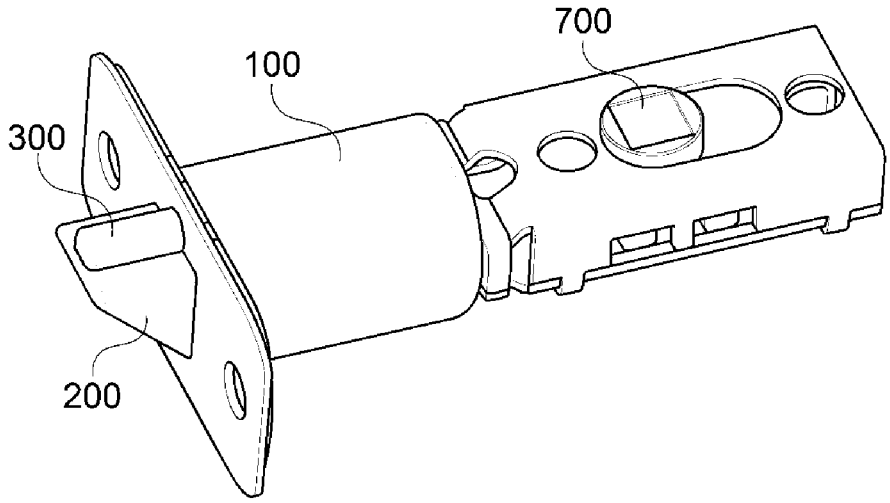

FIGS. 1A and 1B are perspective views illustrating a latch structure 10 according to an embodiment of the present disclosure, in which FIG. 1A is a perspective view of the latch structure 10, and FIG. 1B is a bottom perspective view of the latch structure 10.

Referring to FIGS. 1A and 1B, the latch structure 10 according to an embodiment of the present disclosure may include a body 100, a latch head 200, and a shaft hole 700. The body 100 may be disposed inside a door, and the latch head 200 may be configured to protrude from the body 100 or to retract into the body 100. Specifically, the body 100 may be disposed adjacently to and at the same height as a striker 30 (see FIG. 6) provided on a door frame supporting the door.

Here, the striker 30 may have an opening-closing recess, and the latch head 200 may be located on the body 100 to protrude therefrom so as to be retracted into the opening-closing recess, thereby maintaining the door in a closed position. When the latch head 200 is retracted into the body 100, the latch head 200 may be released from the opening-closing recess, and thus, a user may open the door.

The shaft hole 700 may be connected to a shaft of a handle or a push-pull handle (not shown). When the door is opened, the shaft hole 700 may allow the latch head 200 to be retracted into the body 100 therethrough.

Figure 2:
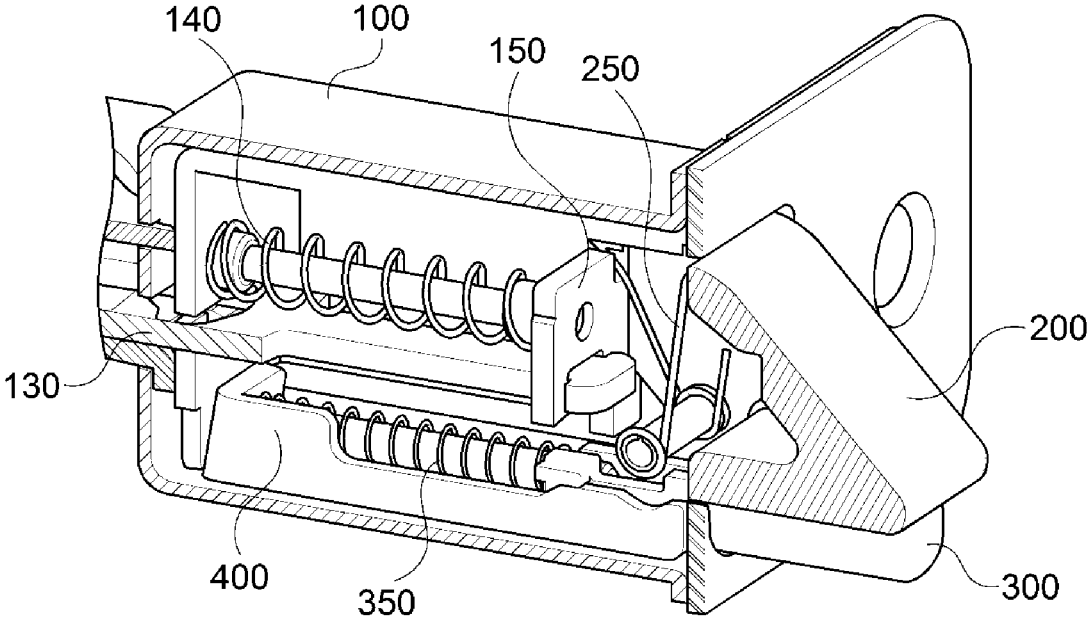
FIG. 2 is a view illustrating the latch structure according to an embodiment of the present disclosure in a situation in which a door is opened.

FIG. 2 is a view illustrating the latch structure 10 according to an embodiment of the present disclosure in a situation in which a door is opened.

Referring to FIG. 2, a locking body 150 configured to move in response to an external operation may be disposed inside the body 100. The locking body 150 may be configured to move in response to an external operation of a user, and may control the operation of the latch head 200 when moved. Here, the latch head 200 may be coupled to a distal end of the locking body 150 to be rotatable to a predetermined angle. When the locking body 150 is moved, the latch head 200 may be rotated to the predetermined angle.

When the locking body 150 is spaced apart at least a predetermined distance in response to the operation of a user, the latch head 200 may be rotated. That is, when the locking body 150 is not moved at least the predetermined distance in a door-closed position, the latch head 200 is not rotatable.

In addition, the latch structure 10 according to an embodiment of the present disclosure may further include a plunger 300 capable of limiting the rotation of the latch head 200. At least a portion of the plunger 300 may protrude from the body 100, and the plunger 300 may be elastically supported through a plunger spring 350 within the body 100. Specifically, the plunger 300 may be located within the body 100 to be in contact with and supported by the plunger spring 350. The other end of the plunger 300 (i.e., a plunger head 310 to be described below) may elastically protrude from the body 100. Here, the plunger 300 may protrude in the same direction as the direction in which the latch head 200 protrudes.

Here, the body 100 may extend by a predetermined length in the direction in which the latch head 200 is protruded or retracted, and may be configured to be hollow inside. In addition, the body 100 may include a frame 110 (see FIG. 7) on which the plunger spring 350 and a locking body spring 140 to be described below are supported. The frame 110 may be provided in the shape of a plate forming a plane perpendicularly intersecting the longitudinal direction of the body 100. The plunger spring 350 and the locking body spring 140 may be fitted into and supported by a plurality of bars extending from the frame 110. The other end of the plunger spring 350 may be in contact with one end of a latch stopper 400 to be described below, and may press and support the latch stopper 400 in a direction opposite to the frame 110.

In a position in which the door is opened, the latch stopper 400 may remain in a downward-pressed position by a rib formed by the plunger 300, as illustrated in FIG. 2. When the plunger 300 remains in the body 100, the latch stopper 400 may prevent the protruding latch head 200 from entering the body. The structure of the plunger 300 will be described in detail with reference to FIG. 3.

Figure 3:
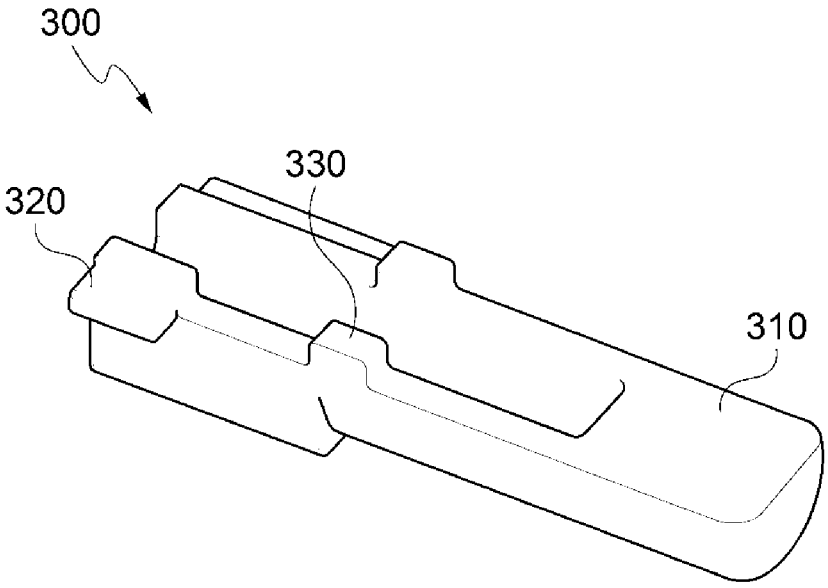
FIG. 3 is a perspective view illustrating the plunger according to an embodiment of the present disclosure.

FIG. 3 is a perspective view illustrating the plunger 300 according to an embodiment of the present disclosure.

Referring to FIG. 3, the plunger 300 may include the plunger head 310 in contact with the striker 30 of the door frame. In addition, a rib 320 may be provided to press the latch stopper 400 to prevent the other end of the latch stopper 400 from being lifted when the plunger 300 protrudes from the body 100 (i.e., in a position in which the door is opened). In addition, the plunger 300 may have a protrusion 330 configured to be caught by the latch head 200. With this configuration, the plunger 300 may be retracted into the body 100 along with the latch head 200 when the latch head 200 is retracted into the body 100.

Figure 4:
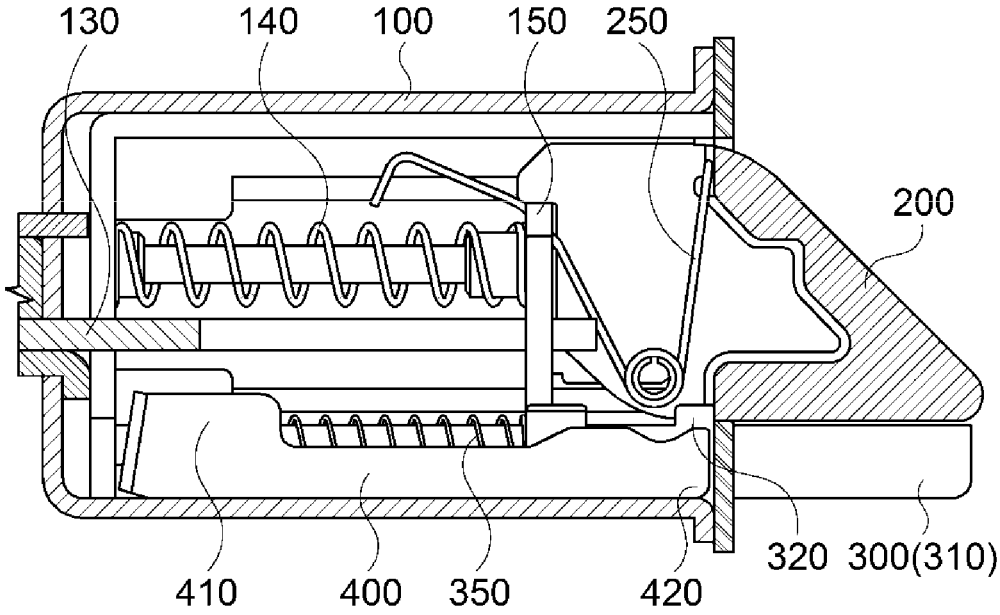
FIG. 4 is a view illustrating a door open position directly before the door is closed.

FIG. 4 is a view illustrating a door open position directly before the door is closed.

Referring to FIG. 4, the latch head 200 may be forced by both the locking body spring 140 pushing the locking body 150 toward the latch head 200 and a latch spring 250 connected to the latch head 200 so as to remain in an outward-protruding position. In addition, in a door open position, both the latch head 200 and the plunger 300 protrude outward. Since one end 410 of the latch stopper 400 located below the plunger 300 within the body 100 is being constantly pushed by the plunger spring 350, the other end of the latch stopper 400 may be constantly under upward-lifting force. This may indicate, in particular, that the force applied to one end 410 of the latch stopper 400 from the plunger spring 350 is converted into force by which the other end 420 of the latch stopper 400 is lifted, due to a slope portion formed on one end 410 of the latch stopper 400.

Since the door is opened when the plunger 300 is in the outward-protruding position, the latch stopper 400 is not required to act on the latch head 200, and thus, the rib 320 protruding from a side portion of the plunger 300 may serve to push the latch stopper 400 downward.

Figure 5:
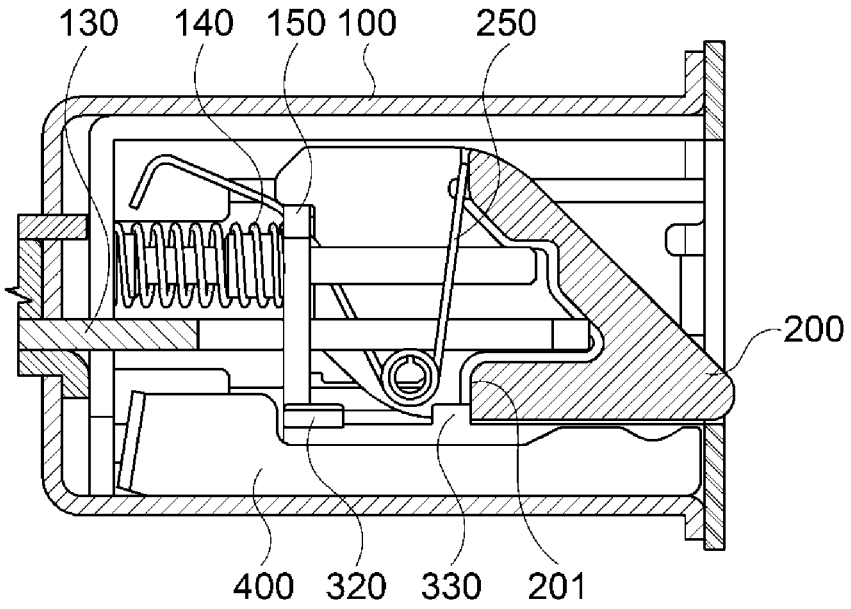
FIG. 5 is a view illustrating a position in which the latch head and the plunger are retracted into the body in a door closing process.

FIG. 5 is a view illustrating a position in which the latch head 200 and the plunger 300 are retracted into the body 100 in a door closing process.

Referring to FIG. 5, in a door closing process, the latch head 200 may be retracted into the body 100 while in contact with a portion of the striker 30 (see FIG. 6) of the door frame and the plunger 300 may also be retracted into the body 100 along with the latch head 200. The plunger 300 has the protrusion 330 protruding upward therefrom. The protrusion 330 may be in contact with while being caught by a catching portion 201 provided on the latch head 200. When the latch head 200 is retracted into the body 100 by a portion of the striker 30 (see FIG. 6), the protrusion 330 caught by the catching portion 201 of the latch head 200 may also be forced into the body 100, thereby enabling the plunger 300 to also be retracted into the body 100 along with the latch head 200.

In addition, as the latch head 200 is retracted into the body 100, the bottom surface of the latch head 200 is located above the latch stopper 400. In this position, the latch head 200 may press the latch stopper 400 downward, thereby preventing the latch stopper 400 from moving upward. Consequently, even when the rib 320 fails to press the latch stopper 400 as the plunger 300 moves, the position of the latch stopper 400 may be maintained by the latch head 200.

Figure 6:
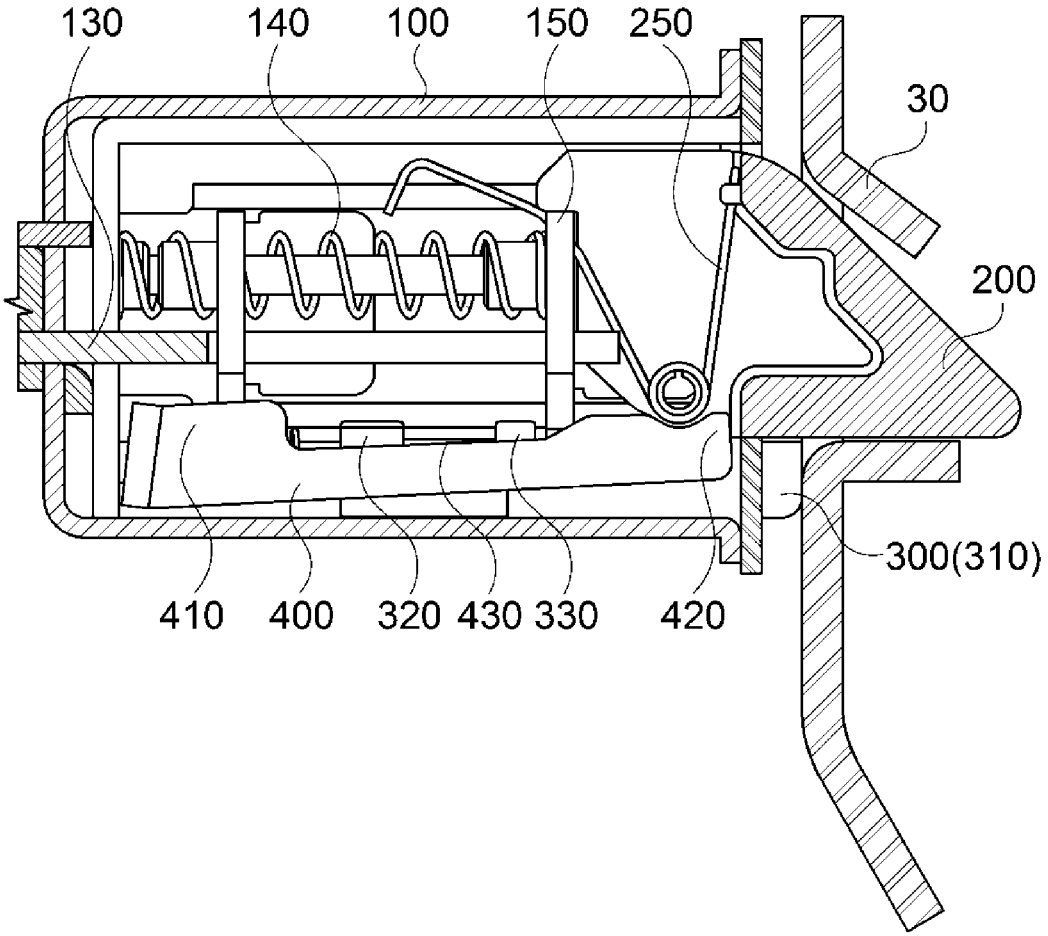
FIG. 6 is a view illustrates a position in which the latch head is received in the striker 30 when the door is closed.

FIG. 6 is a view illustrates a position in which the latch head 200 is received in the striker 30 when the door is closed.

Referring to FIG. 6, since the door is matched to the door frame, when the door is closed, the latch head 200 may be retracted into the opening-closing recess of the striker 30. As described above, the latch head 200 is forced in an outward-protruding direction by double elastic force, when the latch head 200 arrives at a position corresponding to the opening-closing recess of the striker 30, the latch head 200 may protrude toward the opening-closing recess. In this case, the latch head 200 protrudes, while the plunger 300 may be caught by the striker 30 to remain within the body 100 instead of protruding outward.

Since the plunger 300 remains within the body 100 while the latch head 200 protrudes outward, force acting on the latch stopper 400 to press the latch stopper 400 downward may disappear. Thus, the slope portion provided on one end 410 of the latch stopper 400 may be pushed into the body 100 (i.e., to the left in FIG. 6) by the force of the plunger spring 350, and consequently, the other end 420 of the latch stopper 400 may move upward. Here, when the plunger 300 enters the body 100, the movement of the latch stopper 400 may be obstructed by the rib 320 of the plunger 300, thereby obstructing the entrance of the other end 420 of the latch stopper 400 into the latch head 200. In order to prevent this, the latch stopper 400 may be provided with a cutting portion 430. The shape of the cutting portion 430 is not limited as long as the movement of the latch stopper 400 is not obstructed by the rib 320 of the plunger 300 or the like.

Then, the other end 420 of the latch stopper 400 may be retracted toward the catching portion 201 of the latch head 200. Then, the other end 420 of the latch stopper 400 may be caught by the latch head 200 to prevent the latch head 200 from entering the body 100. One end 410 of the latch stopper 400 being pushed by the plunger spring 350 will be described in more detail with reference to FIG. 7.

Figure 7:
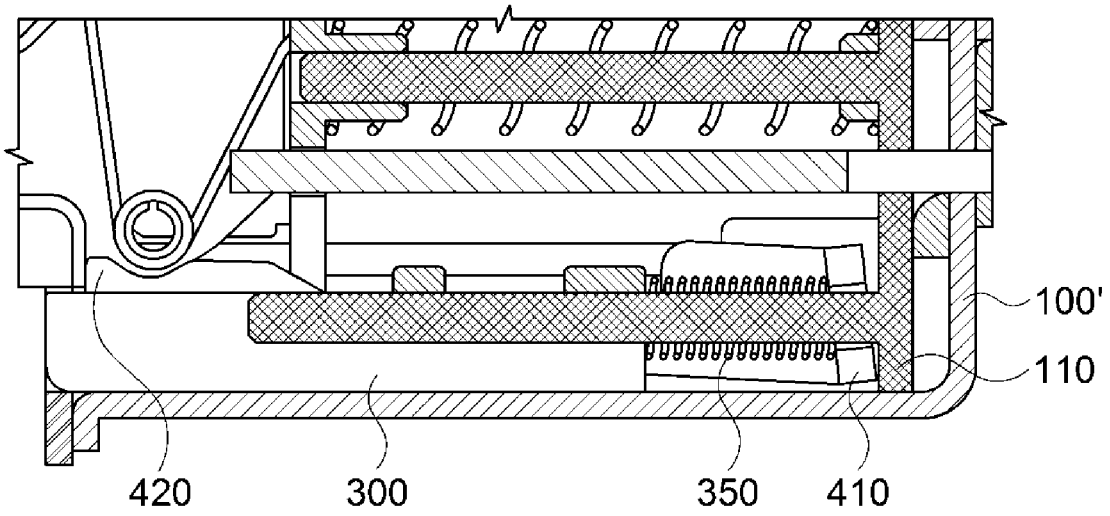
FIG. 7 is an enlarged view illustrating an inverted position of FIG. 6 in order to illustrate the backside of the latch stopper illustrated in FIG. 6.

FIG. 7 is an enlarged view illustrating an inverted position of FIG. 6 in order to illustrate the backside of the latch stopper 400 illustrated in FIG. 6. Thus, the right and left sides of FIG. 7 are reversed from those of FIG. 6.

Referring to FIG. 7, the plunger spring 350 may be held by a bar protruding from the frame 110, and a portion of the plunger spring 350 may be in contact with one end 410 of the latch stopper 400. One end 410 of the latch stopper 400 may be pushed toward the inner circumferential surface 110' of the body 100, more particularly, the frame 110 by the elastic force of the plunger spring 350. As described above, upward movement of the latch stopper 400 has been restricted or held by the rib 320 of the plunger 300 or the latch head 200. As the door is closed, the restriction caused by the plunger 300 and the latch head 200 is released, thereby allowing the latch stopper 400 to move. Then, the latch stopper 400 is inclined by the slope portion of one end 410 of the latch stopper 400 by the force of the plunger spring 350 applied to one end 410 of the latch stopper 400. Consequently, the other end 420 of the latch stopper 400 may be lifted. As a result, the other end 420 of the latch stopper 400 is caught by the catching portion 201 of the latch head 200, so that the latch stopper 400 may prevent the latch head 200 from being retracted into the body 100. Even in the case that external force is applied to the latch head 200 through a foreign object present between the door and the door frame, the latch stopper 400 may prevent the latch head 200 from entering the body 100, thereby maintaining the door in the closed position in which the latch head 200 cannot enter the body 100.

Figure 8:
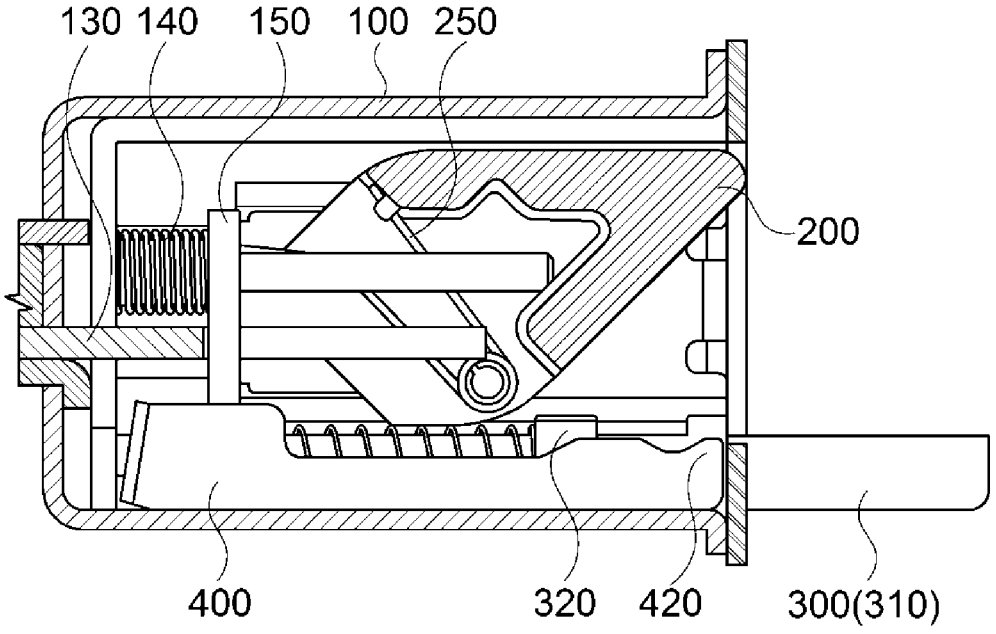
FIG. 8 is a view illustrating a position in which a user is opening the door that has been closed.

FIG. 8 is a view illustrating a position in which a user is opening the door that has been closed.

Referring to FIG. 8, when the shaft connected to the shaft hole 700 is rotated in response to an external operation, the rotating shaft hole 700 may move a link guide 130. The link guide 130 may pull the locking body 150 so that the locking body 150 is spaced apart from the latch head 200 by a predetermined distance (e.g., 2 mm), thereby forming a space in which the latch head 200 may rotate. When a user pushes the door in a position in which the latch head 200 is rotatable, the latch head 200 may be rotated through contact with the striker 30 to enter the body 100. In response to the rotation of the latch head 200, the caught position between the latch stopper 400 and the latch head 200 may be removed, so that the latch head 200 may be released from the latch stopper 400. In addition, as the door is released from the striker, the plunger head 310 of the plunger 300 may be released from the restriction of the striker and thus protrude outward. Then, the rib 320 of the plunger 300 restricts upward movement of the latch stopper 400 again, and thus, the latch stopper 400 may be in a downward-pressed position again. Consequently, the displacement of the locking body 150, and thus, the rotation of the shaft may be reduced. Accordingly, the latch structure (i.e., the tubular latch) according to an embodiment of the present disclosure may also be used in an automatic opening-closing mechanism, such as a push-pull type handle or a motor driving mechanism.

Figure 9:
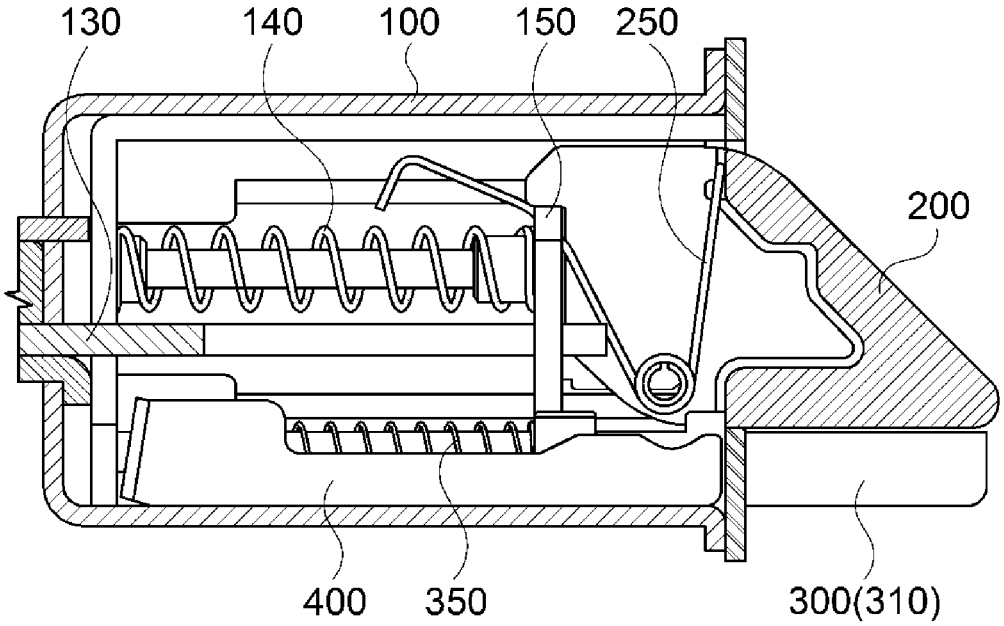
FIG. 9 is a view illustrating a position in which the door is reopened.

FIG. 9 is a view illustrating a position in which the door is reopened.

Referring to FIG. 9, when a user releases the handle as the door is completely opened again, pulling of the link guide 130 is also released. Thus, restoring force of the locking body spring 140 may move the locking body 150 in a direction in which the latch head 200 is protruded outward. In addition, the latch spring 250 may return to the initial position, thereby pushing the latch head 200 in a direction in which the latch head 200 is protruded outward. Consequently, the latch head 200 may be in an outward-protruding position, and the plunger 300 may also be in an outward-protruding position.

Although the exemplary embodiments of the present disclosure have been described in detail hereinabove, a person having ordinary knowledge in the technical field to which the present disclosure pertains will appreciated that various modifications of the foregoing embodiments are possible without departing from the scope of the present disclosure. Therefore, the scope of protection of the present disclosure shall not be limited to the foregoing embodiments but shall be defined by the appended Claims and equivalents thereof.

What is claimed is:

1. A latch structure comprising:

a body disposed inside a door;

a locking body movable in response to an external operation;

a latch head protruding from the body to maintain the door in a closed position and being rotatable when the locking body is spaced apart at least a predetermined distance;

a plunger retracting into the body to prevent the latch head from rotating while the door is being closed; and a latch stopper preventing the protruding latch head from retracting into the body when the plunger is maintained within the body, wherein the locking body is configured to be spaced apart from the latch head by the predetermined distance to form a space in which the latch head rotates while the door is being opened, and the latch head is configured to be released from the latch stopper in response to the rotation of the latch head.

2. The latch structure according to claim 1, wherein the latch stopper comprises a slope portion on one end thereof; and the other end of the latch stopper is retracted into the latch head in response to the slope portion being pushed toward an inner surface of the body.

3. The latch structure according to claim 2, wherein one end of the latch stopper is pushed toward the inner surface of the body by a plunger spring connected to the plunger.

4. The latch structure according to claim 2, wherein the plunger comprises a rib provided on a portion thereof to prevent the other end of the latch stopper from being retracted into the latch head when the plunger is protruded from the body.

5. The latch structure according to claim 1, wherein the latch head prevents the other end of the latch stopper from moving upward when the latch head is retracted into the body.

6. The latch structure according to claim 1, wherein the plunger comprises a protrusion configured to be caught by the latch head when the latch head is retracted into the body, so that the plunger is retracted into the body along with the latch head.

7. The latch structure according to claim 4, wherein the latch stopper comprises a cutting portion configured to prevent the other end of the latch stopper from being retracted into the latch head by the rib of the plunger when the plunger is retracted into the body.

8. The latch structure according to claim 1, further comprising a latch spring providing restoring force to rotation of the latch head.

9. The latch structure according to claim 1, wherein, when a shaft is rotated while the door is being opened, the locking body is pulled by a link guide to form the predetermined distance between the locking body and the latch head.

* * * * *